US005618053A

United States Patent [19]

Moelg et al.

[11] Patent Number: 5,618,053

[45] Date of Patent: Apr. 8, 1997

[54] SHORT SKI-LIKE SPORTS DEVICE

[75] Inventors: Harald Moelg, Kundl, Austria; Wolfgang Wagner, Traunstein, Germany

[73] Assignee: Kneissl Dachstein Sportartikel AG, Austria

[21] Appl. No.: 385,732

[22] Filed: Feb. 8, 1995

Related U.S. Application Data

[63] Continuation of Ser. No. 952,541, Jan. 29, 1993, abandoned.

[30] Foreign Application Priority Data

Jun. 11, 1990 [DE] Germany ..... 9006585 U
Jul. 10, 1990 [DE] Germany ..... 9010388 U

[51] Int. Cl.[6] ..... A63C 5/03; A63C 5/048; A63C 5/052

[52] U.S. Cl. ..... 280/609; D21/229

[58] Field of Search ..... 280/609, 602, 280/87.042; D21/229; D12/8

[56] References Cited

U.S. PATENT DOCUMENTS

| | | | |
|---|---|---|---|
| D. 224,424 | 7/1972 | Schell | 280/87.042 |
| D. 227,688 | 7/1973 | Chase | D21/229 |
| 3,655,211 | 4/1972 | Bollettieri et al. . | |
| 3,724,866 | 4/1973 | Kaplan . | |
| 3,854,739 | 12/1974 | Toda et al. . | |
| 4,343,485 | 8/1982 | Johnston et al. | 280/609 |
| 4,652,006 | 3/1987 | Desoutter | 280/604 |
| 4,705,291 | 11/1987 | Gauer | 280/609 |
| 4,861,063 | 8/1989 | Abondance | 280/60 |
| 4,905,338 | 3/1990 | Mascia . | |
| 4,995,631 | 2/1991 | Hunter | 280/609 X |
| 5,018,760 | 5/1991 | Remondet | 280/609 |
| 5,096,217 | 3/1992 | Hunter | 280/609 X |

FOREIGN PATENT DOCUMENTS

| | | | |
|---|---|---|---|
| 32307 | 6/1988 | Austria . | |
| 387147 | 12/1988 | Austria . | |
| 1201460 | 3/1986 | Canada . | |
| 0298885 | 1/1989 | European Pat. Off. . | |
| 371514 | 6/1990 | European Pat. Off. . | |
| 2446654 | 7/1981 | France . | |
| 2546764 | 12/1984 | France . | |
| 2659023 | 9/1991 | France | 280/609 |
| 2659563 | 9/1991 | France | 280/609 |
| 401775 | 9/1924 | Germany . | |
| 7702479.2 | 1/1977 | Germany . | |
| 2700728 | 7/1977 | Germany . | |
| 2612145 | 9/1977 | Germany . | |
| 3200383 | 9/1982 | Germany . | |
| 4205381 | 8/1992 | Germany | 280/609 |
| 504877 | 3/1971 | Switzerland . | |
| 595118 | 1/1978 | Switzerland . | |
| 1378876 | 5/1988 | U.S.S.R. | 280/609 |

OTHER PUBLICATIONS

Prospect Winterfun of Plast & Form AS., 1975.

*Primary Examiner*—Brian L. Johnson
*Attorney, Agent, or Firm*—Andrus, Sceales, Starke & Sawall

[57] ABSTRACT

A short ski is a board-like member having middle and front sections with the rear and front sections turned upwardly. The ski sole is plastic and the maximum ski length is between 63 to 80 cm and preferably between 70 to 75 cm. The middle section has a minimum width. The front section has the maximum width and the rear section is between the minimum width (B) of the middle section and the maximum width of the front section. The ratio of the minimum width with the middle section to the length is between 0.12 and 0.23, preferably between 0.13 and 0.16. The lateral delimitation of the middle section has the width reduction by two radii (R1, R2) such that radius (R2) of the lateral delimitation adjacent the rear section (10) is about 480 to 500 cm, of the lateral delimitation adjacent the front section is about 250 to 270 cm. The middle section is upwardly curved at a maximum distance from the flat ground (17) of 1.5 mm to 6.0 mm. The rear section in plan view is semicircular, with a radius (R5) of about 5.0 cm to 7.0 cm. The front section has an upturned shovel-like front end, with an outer wavy front edge and at least one cut extending longitudinally of the ski.

14 Claims, 1 Drawing Sheet

SHORT SKI-LIKE SPORTS DEVICE

This application is a continuation of Ser. No. 07/952,541, filed Jan. 29, 1993, now abandoned.

BACKGROUND OF THE INVENTION

The invention is directed to a short ski for a respective foot of a skier.

Such a ski has been known, for example, from CH-A-504877. This type of ski is also called "firn glider" or "figl", respectively. Such a "firn glider" or "figl" has a length of from 65 cm to 75 cm while its width of from 11.5 cm to 12.5 cm is approximately constant along the length thereof. Accordingly, the ratio of width to length is between 0.15 and 0.19. Normally, firn gliders are manufactured as a so-called compound sandwich structure of the type also common with alpine or downhill skis. Manufacture of all-plastics material or of aluminium is also known. As will be apparent from the name, "firn gliders" or "figl" are especially suited for downhill skiing over firn snow or néve. For the rest, especially for downhill running on packed slopes, firn gliders are practically uncontrollable since they have no directional stability at all.

CA-A-1201460 discloses an alpine ski provided in the usual manner with a waist or reduced portion. With a short ski of the instant type, the known reduction which has a radius of several meters results in almost straight sides with the consequence of a complete lack of directional stability of the short ski. Also, it is virtually impossible to swing with such a ski in the conventional way.

CH-A-595118 discloses a slalom ski which has unsymmetrical sides so as to reduce the risk of straddling. However, the known ski is particularly designed for slalom running.

Finally, DE-A-3200383 discloses a downhill ski the upturned front end of which is provided with several longitudinal slots so as to improve directional stability when running on the ski edges.

SUMMARY OF THE INVENTION

The instant invention is based on the objective of providing a short ski of the above-specified kind which is distinguished by turning easily and by exhibiting good directional stability so that it is highly versatile in use, particularly for beginners under the most varied snow or running conditions.

The specified objective is achieved by the forming of a short ski with a reduced configuration of the middle section, which is strongly emphasized, as compared with the conventional downhill ski. Irrespective of the extreme shortness of the ski this promotes high directional stability while the ski will turn and swing easily. The applicants consider it is surprising that the relatively simple measure of a particularly defined reduced portion as more fully disclosed hereinafter can lead to the aforementioned advantages.

Advantageous structural improvements and configurations of the skis are described hereinafter and certain measures are and in this connection the measures specified in claim 4 should be particularly emphasized.

An unsymmetrically configured shovel at the front of the ski permits rolling of the front section of the ski during normal walking or running on ground over which sliding is impossible, similar to the rolling movement of the human foot. Furthermore, due to an the inward displacement of the shovel tip the inner edge is extended relative to that of a conventional "firn glider", whereby a considerably improved running characteristic, especially smooth running of the ski is obtained with the ski being comparatively short. Furthermore, the inward extension of the shovel tips causes both skis when running on snow to be urged inwardly by the snow, i.e. towards each other so as to be closely parallel. This also promotes improved running characteristics.

Finally, a semicircularly rounded rear section—as viewed from above—considerably improves easy turning of the ski, it being possible in the reverse position (rücklage) to run on the rounded rear edge without any detrimental effect on the easy turning-feature.

Accordingly, the claimed dimensioning and shape represent an ideal compromise by which a novel sports device has been created that appeals both to beginners and to top skiers.

Finally, in accordance with an additional preferred feature, an upturned shovel-like front section has at least one cut extending approximately in the longitudinal direction of the ski with, the individual shovel portions being adapted to be adjusted with respect to flexural rigidity.

Having regard to the fact that the ski according to the invention is a novel sports device intended to promote the pleasure taken in sports, this latter feature make it possible to design the front section as a model of the forward end of a human or animal foot.

A future feature of particular significance for running over ground on which gliding are impossible, on the one hand involves forming a front section and a rear section having a flexural rigidity in a vertical longitudinal plane in which each is no greater than one half of the middle section, and for gliding over snow, on the other hand. These measures ensure sufficient rigidity for running over snow, on the one hand, and sufficient flexural resilience for running on ground on which gliding is impossible.

The novel ski may be used similarly to a short ski, on the one hand, and a "firn glider", on the other hand, the running characteristics of the ski being clearly inbetween these two extremes so that there is greater versatility as regards the use of the ski.

BRIEF DESCRIPTION OF THE DRAWINGS

Below, an embodiment of a ski according to the invention is explained in detail with reference to the accompanying drawing, in which.

DESCRIPTION OF THE ILLUSTRATED EMBODIMENT

Figure 1:
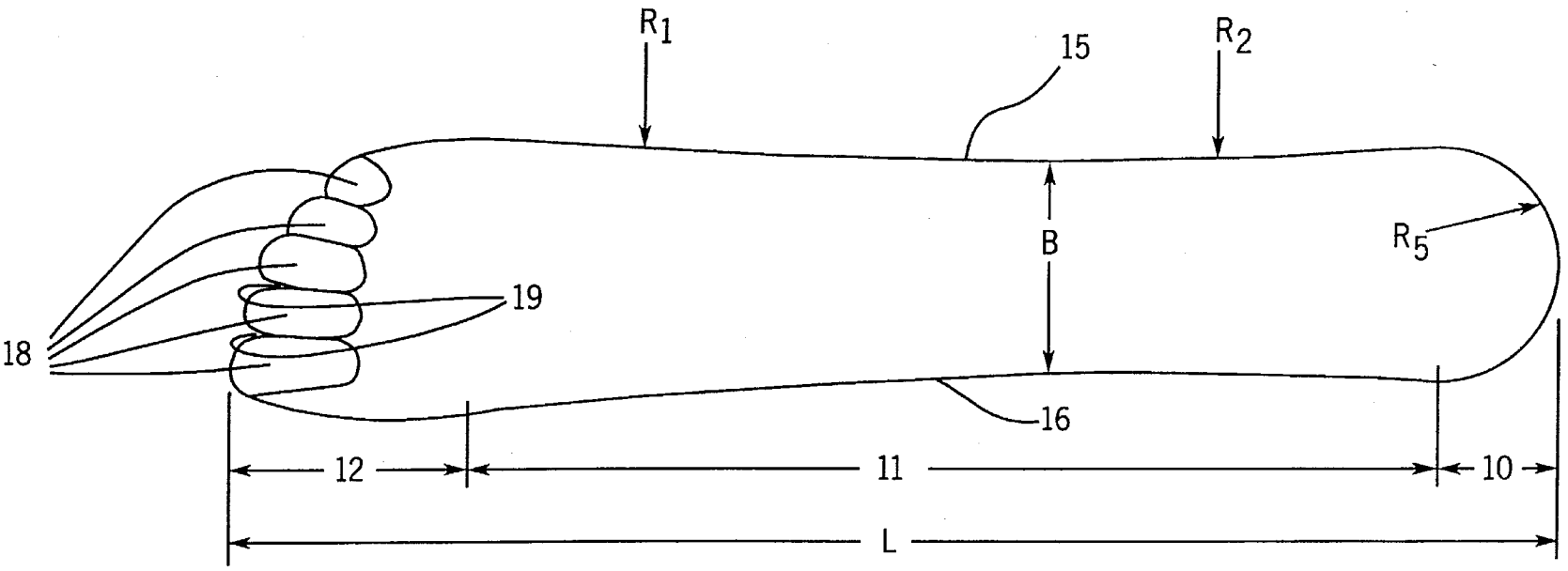
FIG. 1 is a plan view of a ski.
Figure 2:
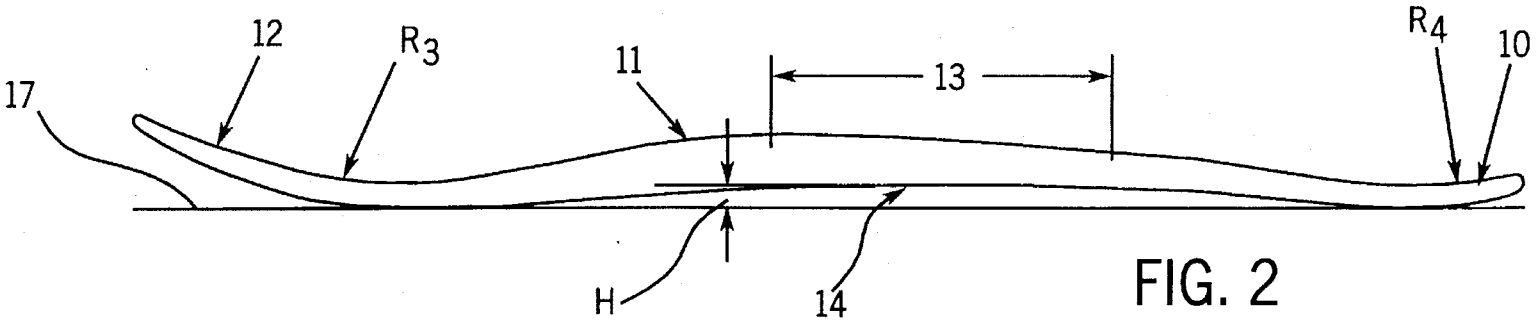
FIG. 2 is a side view of a ski shown in FIG. 1.

Accordingly, the short ski illustrated in FIGS. 1 and 2 comprises a board-like rear section 10, middle section 11 and front section 12, the latter section being turned up like a shovel similar to conventional downhill and/or cross-country skis. At the top of the middle section 11 some means or a binding, which is not illustrated, for fixing the boot of a user can be mounted in an area 13 which, as is shown in FIG. 2, in rearward direction or towards the rear section 10 is directly adjacent the dividing line that divides the ski body into a front and a rear half of approximately equal size. A conventional downhill ski binding or a touring ski binding may be used as the binding. It is also conceivable to mount a binding which is suited for securing hard ski boots as well as flexible walking boots.

The bottom of the rear as well as of the middle and front sections 10, 11, 12 are provided with a running surface or sole 14 of plastics material, especially polyethylene, polyamide or mixtures thereof. As will be apparent from FIG. 1, the sides 15, 16 of the middle section 11 are of reduced configuration.

The maximum projecting length "L", i.e. the maximum length in a horizontal projection, is between about 63 cm and about 80 cm, in particular between about 70 cm and about 75 cm. A particularly suitable length is 64.0 to 65.0 cm.

As will be further apparent from FIG. 1, the ratio of the minimum width "B", which corresponds to the maximum reduction in the middle section 11, to the maximum length "L" is about 0.12 to about 0.23, especially about 0.13 to about 0.16. In the illustrated embodiment the front section 12 is the section of maximum width, whereas the width of the rear section 10 is in between the minimum width "B" in the vicinity of the middle section 11 and the maximum width in the vicinity of the front section 12. In one embodiment the maximum width of the front section 12 is about 12 to 14 cm, in particular about 13 cm, whereas the width of the rear section 10 is about 10 to 12 cm, in particular about 11 cm.

The reduced middle section 11 has a length which in the present case corresponds to about 75%, of the overall projecting length "L". This dimensioning of 75% has been found to be particularly suitable.

As will be apparent from FIG. 2, the middle section 11 is upwardly biased so that in the unloaded state the sole 14 has a predetermined distance "H" from the flat ground 17, said distance being within an order of magnitude of from 1.0 to 6.0 mm, in particular about 2.0 mm.

The shovel-like upturned front section 12 represents a model of the forward end of a human foot, i.e. it comprises five toes wherein a longer cut 19 is respectively formed between the three larger toes, said cut extending in longitudinal direction of the ski. Thereby a kind of multi-flexible tip or shovel is constituted. It is also possible to have the cuts 19 extend right to the "roots of the toes". The two smaller toes may be combined to form a single larger, i.e. broader "toe".

Along the sides, the sole 14 is delimited by steel edges which are not illustrated.

As already explained above, the middle section 11 may also be flat or it may be slightly (1 to 4 mm) biased or curved in downward direction. This makes the ski especially easy to turn and particularly well suited for beginners. Also, the sole 14 may be formed as is known per se with at least one longitudinal guide groove for enhancing directional stability. Basically, however, such a longitudinal guide groove need not be provided because of the waist or reduction of the middle section 11. To this end, the side which in the mounted state is the inner side (the side 16 in the instant case) of the middle section has reduced or concavely curved configuration.

As shown in FIG. 1, the rear section 10 is somewhat semicircularly rounded as viewed from above. Also, the rear section 10 is slightly turned up. Thereby, getting caught in the ground or snow while swinging or "dancing" can be prevented.

According to FIG. 1 the middle section 11 is symmetrically reduced, the radius of the reduction or waist increasing from the front section 12 towards the rear section 10. The lateral reduction of the middle section 11 is defined by two radii R1 and R2, wherein the radius R2 of the portion of the lateral delimitation of the middle section adjacent the rear section 10 is larger, especially nearly twice as large as the radius R1 of the portion of the lateral delimitation of the middle section 11 adjacent the front section 12.

In an embodiment having an overall length L of about 64.5 cm and a minimum width B of about 10 cm and a maximum width of about 13 cm, R1 is about 250 to 270, particularly about 260 cm, and R2 is about 480 to 500 cm, particularly about 490 cm.

The radii R3 and R4 of the upturned front section 12 and the upturned rear section 10 each amount to about 20 to 30 cm, particularly about 20 to 24 cm.

The distance of the free end of the upturned section 12 from the flat ground 17 is about 3.0 to 4.0 cm, particularly about 3.5 cm, whereas the distance of the rear section 10 from the flat ground 17 is about 1.0 to 1.5 cm.

The radius R5 of the semicircular end of the rear section 10 is about 5.0 cm to 7.0 cm, in particular about 5.5 cm.

The rear section 10 and the front section 12 exhibit a flexural rigidity along the vertical longitudinal axis which in either case is at most half the corresponding flexural rigidity of the middle section 11 so that sufficient rigidity for running over snow as well as a sufficiently high flexural resilience for running on hard ground is ensured.

Finally, it is apparent from FIG. 1 that the front section as viewed from above is unsymmetrical such that the farthest forward tip or "toe" is displaced laterally inwardly to such an extent that it is approximately at the level of the maximum reduction of the inner side 16 of the middle section 11.

We claim:

1. A short ski forming one of a pair of like short skies for alpine downhill skiing, comprising a board member having a rear section (20), middle section (11) and front section (12) and having an inner side edge and an outer side edge throughout all of said sections and defining a lateral delimitation of said sections, said front section having a forward portion curving upwardly, the middle section (11) adapted to having a single boot binding attached thereto for securing the boot of a user to the ski, and wherein the maximum length (L) of the ski is between 63 cm and 80 cm and the ratio of the minimum width and lateral delimitation (15,16) of the middle section to the length (L) of the ski is between 0.12 and 0.23, said middle section lateral delimitation (15, 16) being less than the lateral delimitations of said front section and less than the lateral delimitation of said rear section, said middle section has said outer side edge with a first radius (R1) and second radius (R2), said second radius (R2) on said outer side edge extending from the rear section (10) forwardly toward said first radius (R1) and said second radius (R2) being in the range of about 480 to 500 cm, and said first radius (R1) extending from said second radius (R2) to the front section (12) and said first radius being in the range of about 250 to 270 cm, said forward portion of said front section (12) as viewed from the top of the board member has an unsymmetrical front edge formed as a continuous extension of said inner and said outer side edges of said front section and defining a forward-extending tip displaced laterally inwardly relative to the side edges of the front section adjacent said middle section, said inner side edge of said tip being displaced inwardly substantially less than said outer side edge of said tip and thereby forming an elongated inner side edge on said front section for cutting engagement with the snow.

2. The ski of claim 1, wherein said radius (R2) is about 490 cm and said radius (R1) is about 260 cm.

3. The ski of claim 1, wherein rear section (10) has a semicircular back side edge having a radius (R5) of about 5.0 cm to 7.0 cm.

4. The ski of claim 3, wherein said radius (R5) is 5.5 cm.

5. The ski of claim 1, wherein said middle section is curved downwardly from a central portion to said front section and said rear section, and said forward extending tip is approximately of a length equal to the maximum lateral delimitation of said middle section (11).

6. The ski as claimed in claim 5, wherein the maximum width of the front section (12) is 12 cm to 14 cm and the width of the rear section (10) is 10 cm to 12 cm.

7. The ski of claim 6, wherein said width of said front section is 13 cm, and said width of said rear section is 11 cm.

8. The ski of claim 1, wherein said middle section (11) has a length in the range of 70% to 75% of the overall length (L) of the ski.

9. The ski of claim 1, wherein said middle section (11) is curved upwardly from said front and rear section and in the unloaded state of the ski the sole (14) in the middle section is at a maximum distance (H) from flat ground (17) in the range of 1.5 mm to 6.0 mm.

10. The ski of claim 9, wherein said range of the maximum distance from flat ground is from 2.0 mm to 3.0 mm.

11. The ski of claim 1, wherein said front section (12) and said rear section (10) curve upwardly at a radius in the range of 20 cm to 30 cm.

12. The ski of claim 11, wherein the distance of the outermost end of the front section (12) from the flat ground (17) is 3.0 cm to 4.0 cm, and the distance of the outermost end of the rear section (10) from the flat ground (17) is 1.0 to 1.5 cm.

13. The ski of claim 1, wherein said rear section (10) and said front section (12) have a flexural rigidity in a vertical longitudinal plane, said middle section has a flexural rigidity in said vertical longitudinal plane, the flexural rigidity of each of said front and rear sections being at most half the flexural rigidity of the middle section (11).

14. A short ski for forming one of a pair of like short skies for alpine downhill skiing, comprising a board member having a rear section (10), middle section (11) and front section (12) and having an inner side edge and an outer side edge throughout all of said sections and defining the lateral delimitation of all of said sections, said board member having a total length of about 63 cm, said middle section (11) is constructed having said inner edge and said outer edge defining a lateral delimitation (15, 16) of about 10 cm and being less than the lateral delimitation of said front section and less than the lateral delimitation of said rear section, said front section having a forward portion curving upwardly, the middle section (11) adapted to have a single boot binding attached thereto for securing the boot of a user to the ski, said front portion of said front section (12) as viewed from the top of the member has an unsymmetrical front edge formed as a continuation of said inner and said outer side edges of said front section and defining a forward-extending tip displaced laterally inwardly relative to the side edges of the front section adjacent said middle section, said inner side edge of said tip being displaced inwardly substantially less than said outer side of said tip and thereby forming an elongated inner side edge for cutting engagement with the snow.

* * * * *